US007396292B1

(12) United States Patent
Grossbard

(10) Patent No.: US 7,396,292 B1
(45) **Date of Patent: *Jul. 8, 2008**

(54) GOLF PUTTER WITH CONCAVE CYLINDRICAL OR SPHERICAL STRIKING SURFACE

(76) Inventor: Steven Grossbard, 1184 Coldwater Canyon Dr., Beverly Hills, CA (US) 90210

( * ) Notice: Subject to any disclaimer, the term of this patent is extended or adjusted under 35 U.S.C. 154(b) by 0 days.

This patent is subject to a terminal disclaimer.

(21) Appl. No.: 11/827,229

(22) Filed: Jul. 10, 2007

Related U.S. Application Data

(63) Continuation of application No. 11/651,866, filed on Jan. 10, 2007, now Pat. No. 7,264,557.

(51) Int. Cl.
*A63B 53/04* (2006.01)

(52) U.S. Cl. ..... 473/325; 473/330; 473/340

(58) Field of Classification Search ..... 473/324–350, 473/219–256, 286, 412; D21/736–746, 759
See application file for complete search history.

(56) References Cited

U.S. PATENT DOCUMENTS

| | | | | |
|---|---|---|---|---|
| 1,334,189 | A | 3/1920 | Swanson | |
| 1,503,291 | A | 7/1924 | Rimmer | |
| 2,472,978 | A | 6/1949 | Mahon | |
| 2,693,960 | A | 11/1954 | Bour | |
| 2,826,417 | A | 3/1958 | Mario | |
| D201,811 | S | 8/1965 | Kroll | |
| 3,632,112 | A | 1/1972 | Jacobs | |
| 3,881,733 | A | 5/1975 | Csemits | |
| 4,165,076 | A | 8/1979 | Cella | |
| 4,260,157 | A | 4/1981 | Jones et al. | |
| 4,290,606 | A | 9/1981 | Maxwell | |
| 4,453,713 | A | 6/1984 | Guyer | |
| 4,486,019 | A | 12/1984 | Sievers | |
| 4,846,477 | A | 7/1989 | Phelan | |
| 5,456,464 | A | 10/1995 | Davenport et al. | |
| 6,162,131 | A | 12/2000 | Falzone | |
| 6,267,690 | B1 | 7/2001 | Salmon | |
| 6,402,638 | B1 | 6/2002 | Kelley | |
| 6,406,380 | B1 | 6/2002 | Jackson | |
| 6,435,979 | B1 | 8/2002 | Mounfield, Jr. | |
| 6,520,865 | B1 * | 2/2003 | Fioretti | 473/251 |
| D486,541 | S | 2/2004 | Bettinardi | |
| 6,692,378 | B2 | 2/2004 | Shmoldas et al. | |
| 6,863,617 | B2 | 3/2005 | Park | |
| 6,984,181 | B2 | 1/2006 | Hettinger et al. | |
| 7,056,227 | B2 | 6/2006 | Giraldi | |
| 7,264,557 | B1 * | 9/2007 | Grossbard | 473/325 |

* cited by examiner

*Primary Examiner*—Sebastiano Passaniti
(74) *Attorney, Agent, or Firm*—Cislo & Thomas, LLP

(57) ABSTRACT

A golf putter having a shaft and a putting head connected to the shaft, where the putting head has a first contact surface, a rear wall, a top surface, and a sole. The first contact surface has a concave, partially-spherical face. In a version of the invention, the first contact surface has a first concave, cylindrical face instead of the partially-spherical face. Some versions have a second contact surface opposite the first contact surface. The first contact surface and the second contact surface may have a partially-spherical face, a cylindrical face, or a combination of the two faces. In embodiments with two contact surfaces, the shaft is configured to be reversible such that either contact surface can be used.

16 Claims, 7 Drawing Sheets

GOLF PUTTER WITH CONCAVE CYLINDRICAL OR SPHERICAL STRIKING SURFACE

CROSS-REFERENCE TO RELATED APPLICATION

This document is a continuation application with, and claiming priority from U.S. patent application Ser. No. 11/651,866, entitled "Golf Putter with Concave Cylindrical or Spherical Striking Surface," filed Jan. 10, 2007 now U.S. Pat. No. 7,264,557.

BACKGROUND OF THE INVENTION

1. Technical Field

This invention relates to putting heads for use in the game of golf.

2. Background Art

One of the more difficult aspects of playing the game of golf is how to properly make putts, and one of the critical aspects of making a putt is proper contact between the golf putter and the golf ball. As such, there is a need for a golf putter to help ensure proper contact with the golf ball. One way of accomplishing this is by having a contact surface that has a radius, allowing the contact surface to cup the golf ball at the moment of contact and helping the struck golf ball to proceed away from the putter in the desired direction.

BRIEF SUMMARY OF INVENTION

The present invention is directed to a golf putter having a shaft and a putting head connected to the shaft, where the putting head has a first contact surface, a rear wall, a top surface, and a sole.

The first contact surface has a first concave, partially-spherical face. The first partially-spherical face has a radius, a first perimeter edge, a second perimeter edge, an apex, and a depth. The depth of the first partially-spherical face is defined as the distance between the apex and a plane defined by the first perimeter edge and second perimeter edge. In a version of the invention, the first contact surface has a first concave, cylindrical face instead of the partially-spherical face.

The rear wall is opposite the first contact surface. The shaft is connected to the putting head at the top surface. The top surface is connected to the first contact surface at a top edge of the first contact surface, and the top surface is connected to the rear wall at a top edge of the rear wall.

The sole is opposite the top surface. The sole is connected to the first contact surface at a bottom edge of the first contact surface, and the top surface is connected to the rear wall at a bottom edge of the rear wall.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1A:
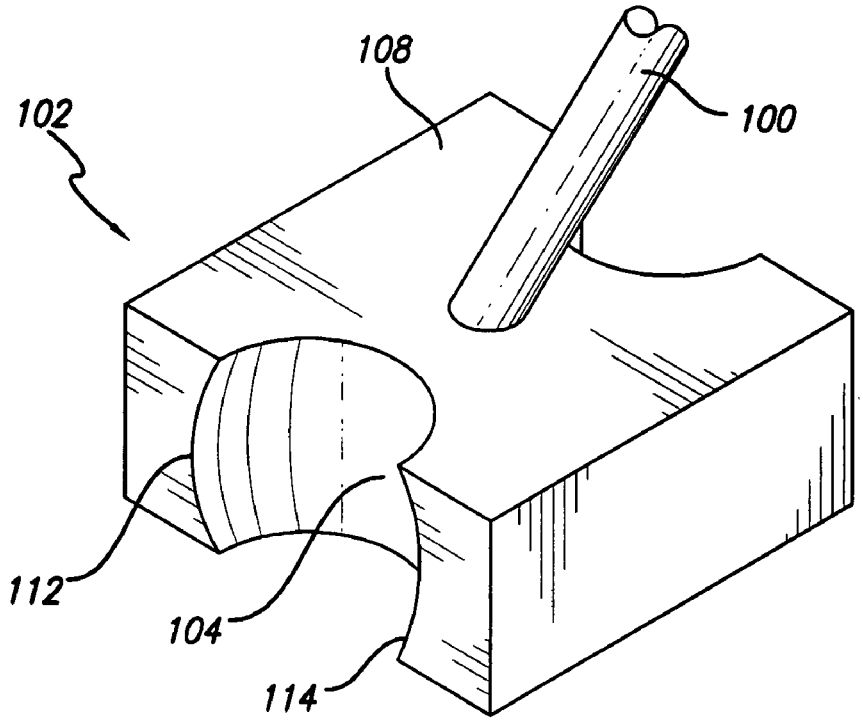
FIG. 1A is a perspective view of an embodiment of the current invention with a Concave Spherical Striking Surface.
Figure 1B:
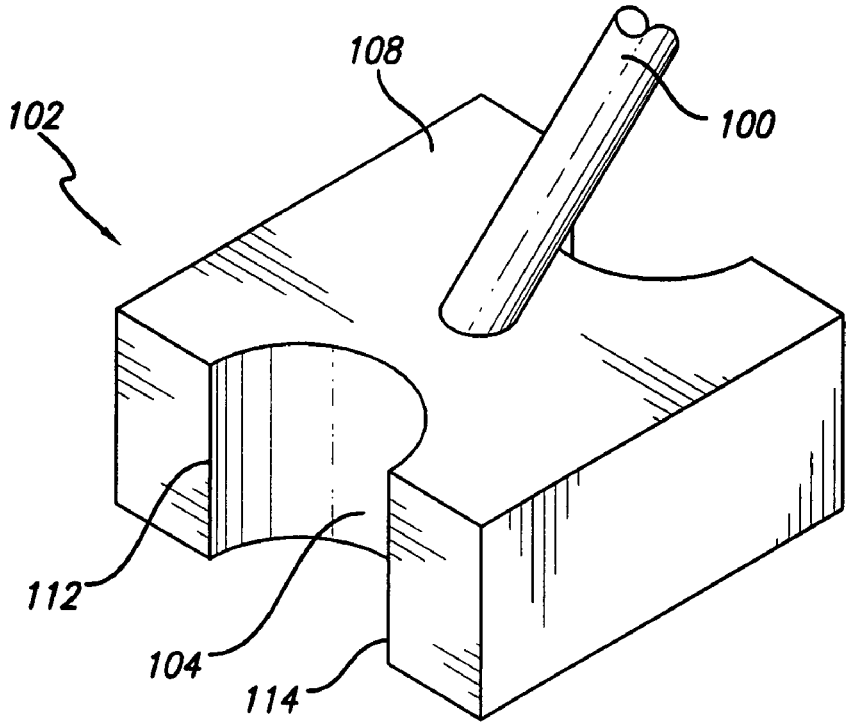
FIG. 1B is a perspective view of an embodiment of the current invention with a Concave Cylindrical Striking Surface.

FIG. 1A and FIG. 1B show a golf putter comprising a shaft 100 and a putting head 102 connected to the shaft 100. The putting head 102 comprises a first contact surface 104, a rear wall 224, a top surface 108, and a sole 226.

The first contact surface 104 can be concave. Having a concave face, particularly one where the radius of curvature is similar to that of a golf ball will help teach the golfer to swing the putter in a straight path. Any deviation from a straight path swing will be evident when using this putter. For example, if the face of the putter is rotated so as to deviate from a straight path the putter will not receive the golf ball properly.

Figure 5:
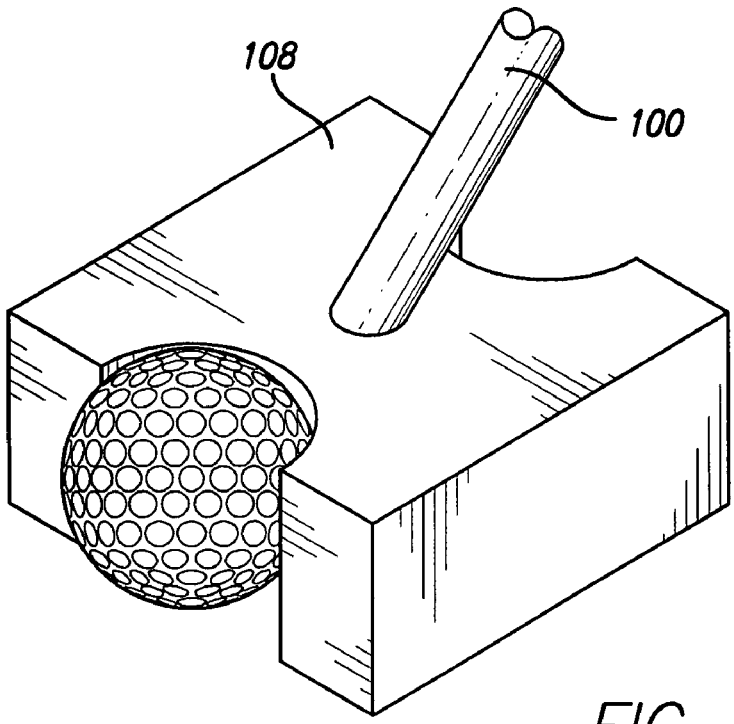
FIG. 5 is a perspective view of an embodiment of this invention.
Figure 8A:
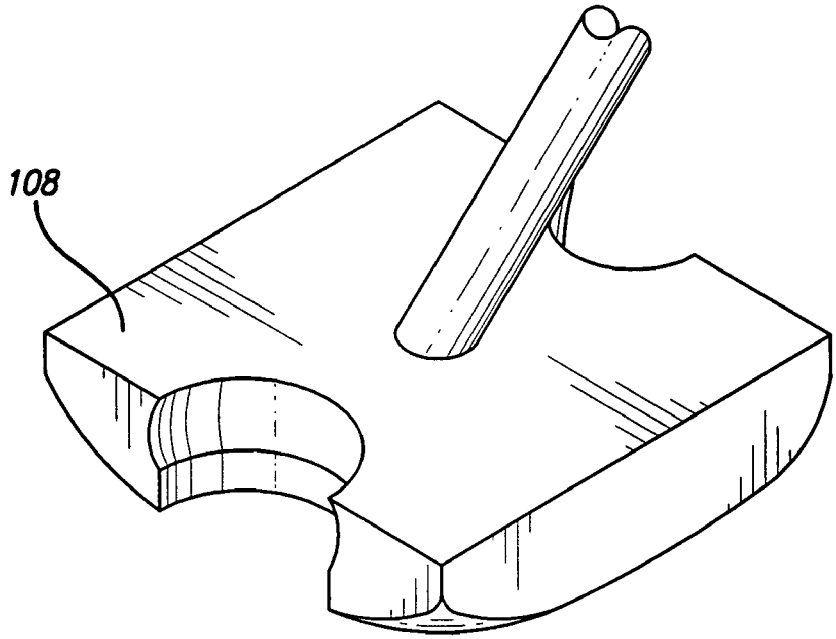
FIG. 8A is a perspective view of another embodiment of this invention.
Figure 8B:
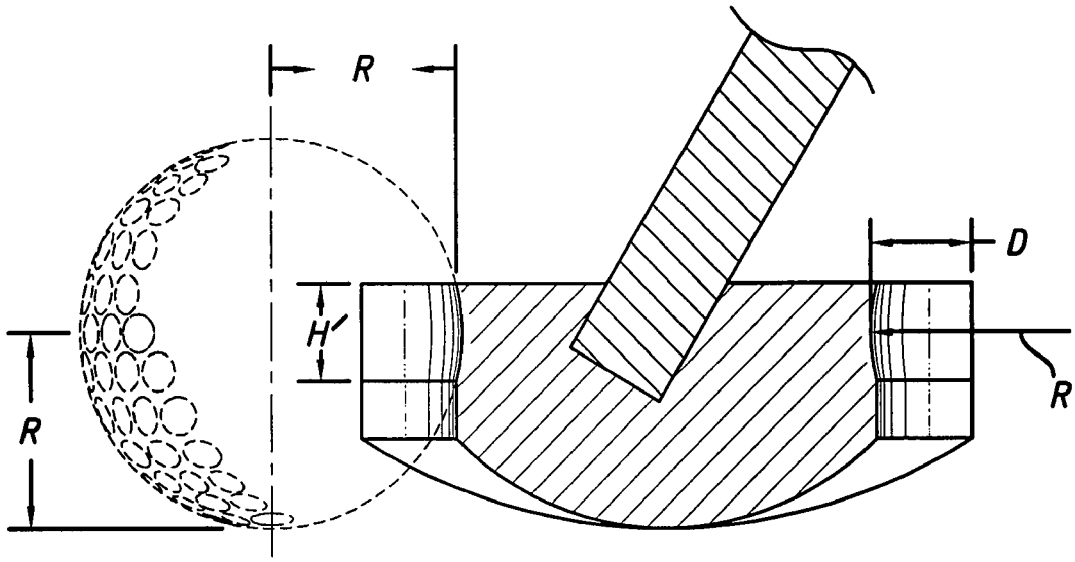
FIG. 8B is a cross section of a side view of another embodiment of this invention.

In one embodiment the first contact surface 104 can be partially-spherical as shown in FIG. 1A. In another embodiment the first contact surface 104 can be partially-cylindrical as shown in FIG. 1B. The first contact surface 104 further comprises a first radius R, a first perimeter edge 112, a second perimeter edge 114, a first apex 202, and a first depth D. The first radius R can be at least the same measurement as a golf ball radius as shown in FIG. 5. It is understood by those skilled in the art that a golf ball has a diameter of about 1.68 inches (47.2 mm); so the radius of a golf ball is about 0.84 inches (23.6 mm). The first radius R can also be greater than the radius of a golf ball so as to decrease the degree of the curvature of the first contact surface 104. The first apex 202 is defined as an imaginary vertical line along the first contact surface 104 that is the farthest away from a first plane created by the first perimeter edge 112 and the second perimeter edge 114 of the first contact surface 104, where the distance is measured orthogonal to the first plane. The first depth D is defined as a distance between the first apex 202 and the first plane. The first depth D of the first contact surface 104 can be at least one-half the radius of a golf ball as shown in FIG. 8B. In a preferred embodiment the first depth D of the first contact surface 104 is about the same measurement as the radius of a golf ball. In another preferred embodiment, the first depth D is about the same measurement as the diameter of a golf ball as shown in FIG. 5.

Figure 2A:
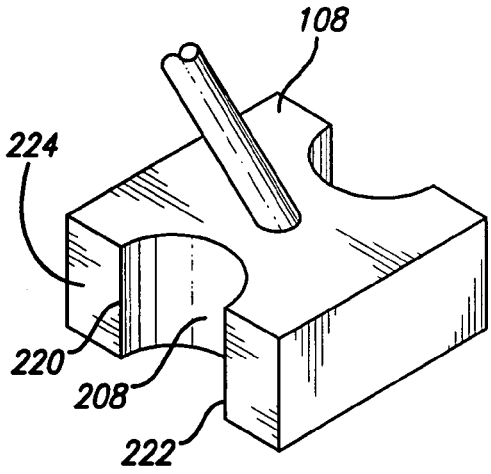
FIG. 2A is a rear perspective view of an embodiment of the current invention.
Figure 2B:
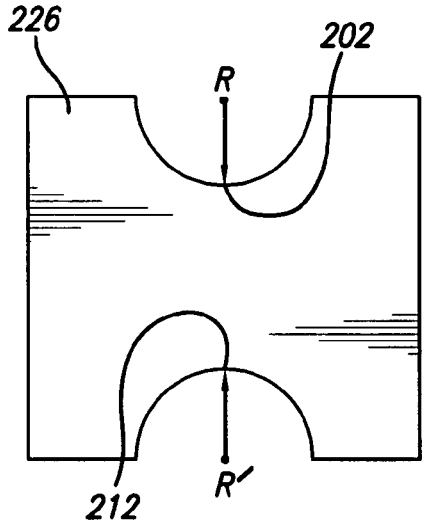
FIG. 2B is a bottom view of an embodiment of the current invention.
Figure 2C:
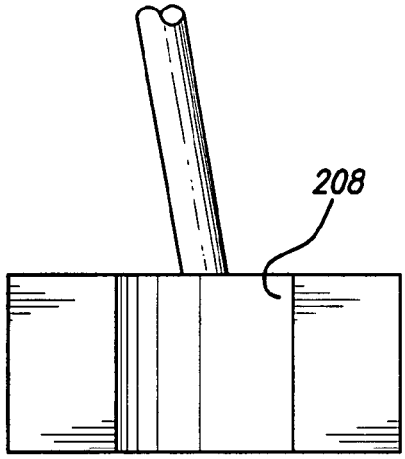
FIG. 2C is a rear view of an embodiment of the current invention.
Figure 2D:
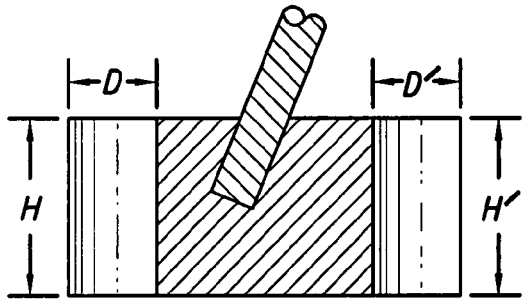
FIG. 2D is a side view of a cross section of an embodiment of the current invention.
Figure 3A:
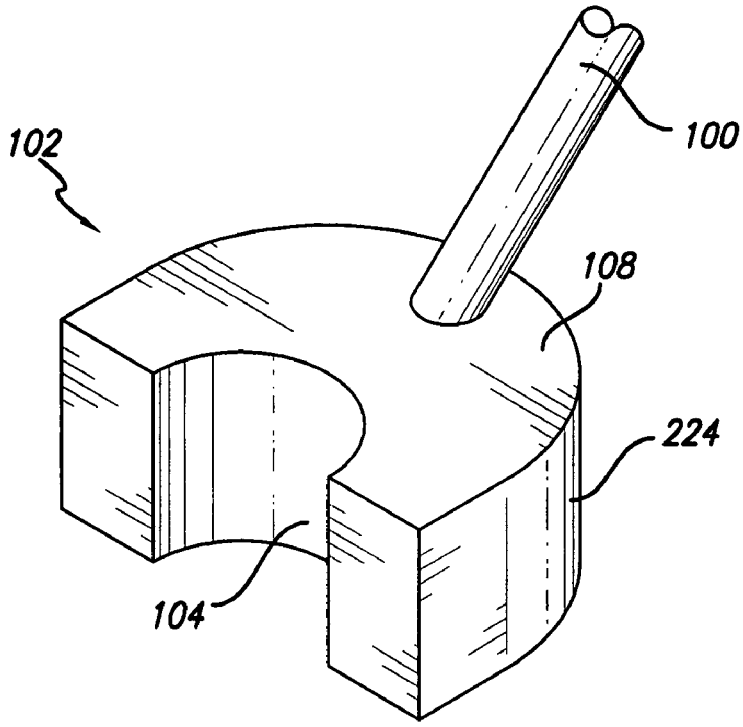
FIG. 3A is a perspective view of another embodiment of the current invention.
Figure 3B:
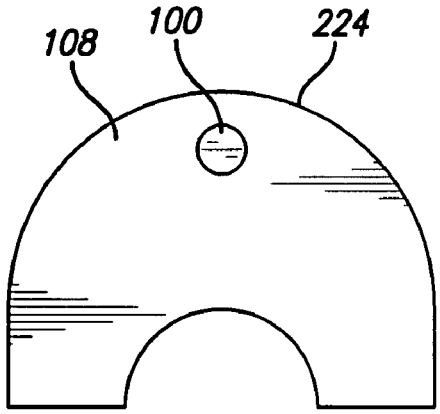
FIG. 3B is a top view of another embodiment of the current invention.
Figure 3C:
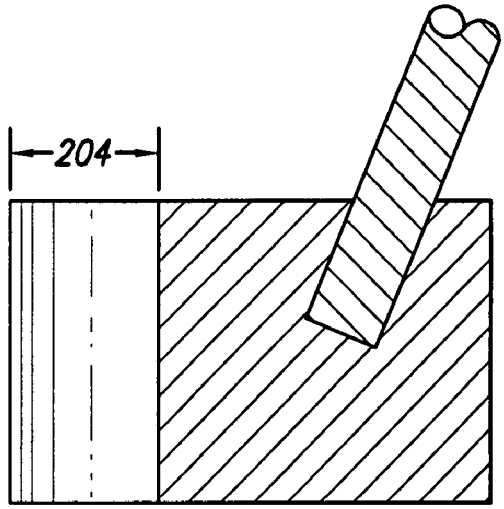
FIG. 3C is side view of a cross section of an embodiment of the current invention.

The rear wall 224 is opposite the first contact surface 104. The rear wall 224 can be flat, as shown in FIG. 2A, or curved like a semi-circle, as shown in FIGS. 3A and 3B.

The rear wall 224 can further comprise a second contact surface 208. In one embodiment the second contact surface 208 can be the same shape as the first contact surface 104, thereby providing a reversible putter. This could be beneficial for an ambidextrous golfer. Alternatively, the second contact surface 208 can be substantially flat. In another embodiment, the second contact surface 208 can be concave as shown in FIG. 2A. The second contact surface 208 can be partially-spherical or it can be partially-cylindrical. The second contact surface 208 further comprises a second radius R', a third perimeter edge 220, a fourth perimeter edge 222, a second apex 212, and a second depth D'. The second radius R' can be at least the same measurement as the golf ball radius. The second radius R' can also be greater than the radius of a golf ball so as to decrease the degree of the curvature of the second contact surface 208. The second apex 212 is defined as an imaginary vertical line along the second contact surface 208 that is the farthest away from a second plane created by the third perimeter edge 220 and the fourth perimeter edge 222 of the second contact surface 208. The second depth D' is defined as a distance between the second apex 212 and the second plane. The second depth D' of the second contact surface 208 can be at least one-half the radius of a golf ball. In a preferred embodiment the second depth D' of the second contact surface 208 is the same measurement of the radius of a golf ball. In another embodiment of this invention, the second depth D' is about the same measurement as the diameter of a golf ball.

Figure 6A:
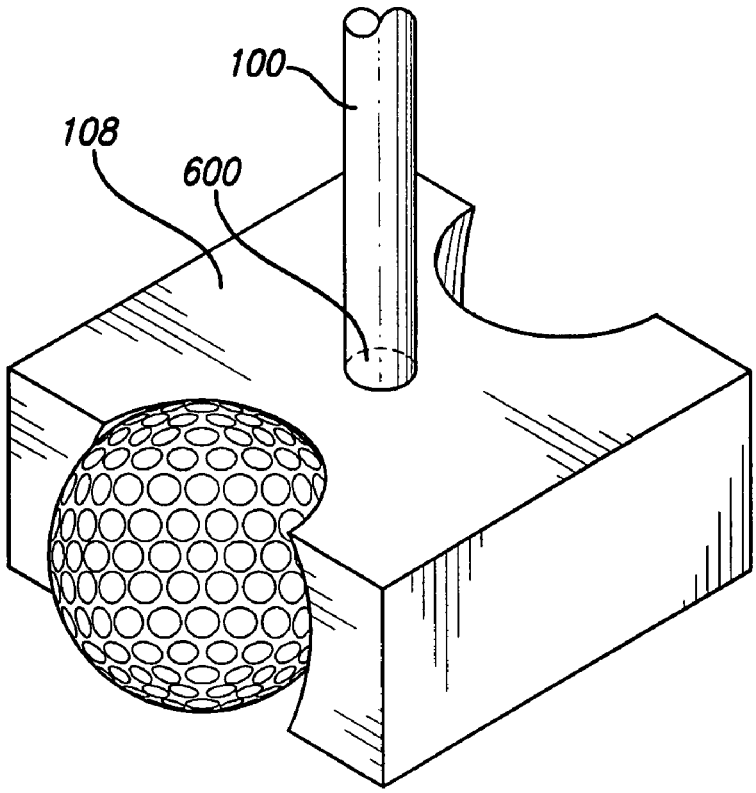
FIG. 6A is a perspective view of another embodiment of this invention.

The shaft 100 is connected to the putting head 102 at the top surface 108. In embodiments where the golf putter comprises a first contact surface 104 and a second contact surface 208, the shaft 100 can be attached in a way that would facilitate the ability to use either the first contact surface 104 or the second contact surface 208. In one embodiment, the shaft 100 is connected orthogonal to the top surface 108 via an attachment hole 600 as shown in FIG. 6A. Having the shaft 100 orthogonal to the top surface 108 creates a symmetry that allows the golfer to putt with the first contact surface 104 or the second contact surface 208 merely by rotating the golf putter to the proper orientation.

Figure 6B:
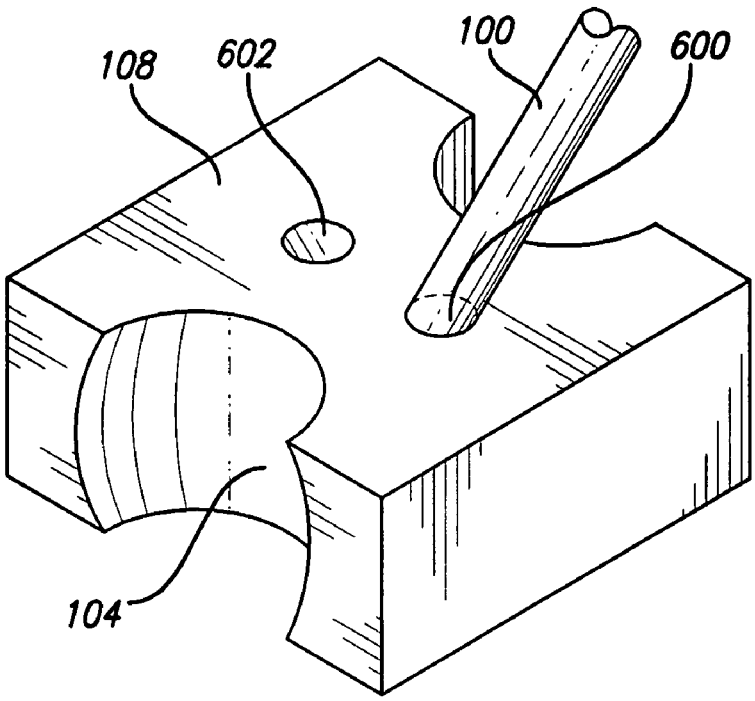
FIG. 6B is a perspective view of another embodiment of this invention.

In another embodiment the shaft 100 does not have to be orthogonal to the top surface 108 but can be detachably coupled to the top surface 108. Most golf clubs and putters are angled towards the heel of the putter so as to allow the golfer to have a comfortable stance. However, such putters are designed to be swung in only one direction. In one embodiment the top surface 108 can have two attachment holes 600, 602 for the insertion of the shaft 100 as shown in FIG. 6B. When the shaft 100 is inserted in the first attachment hole 600 the shaft 100 is angled towards the golfer so as to allow the golfer to assume a comfortable stance and use the first contact surface 104. When the shaft 100 is inserted in the second attachment hole 602 the shaft 100 is angled towards the golfer so as to allow the golfer to assume a comfortable stance and use the second contact surface 208. The shaft can be secured either through resistance between the shaft 100 and the attachment hole 600, 602 or by having the shaft 100 screw into the attachment hole 600, 602, or any other method known it the art for securing removable shafts into an attachment hole.

Figure 7A:
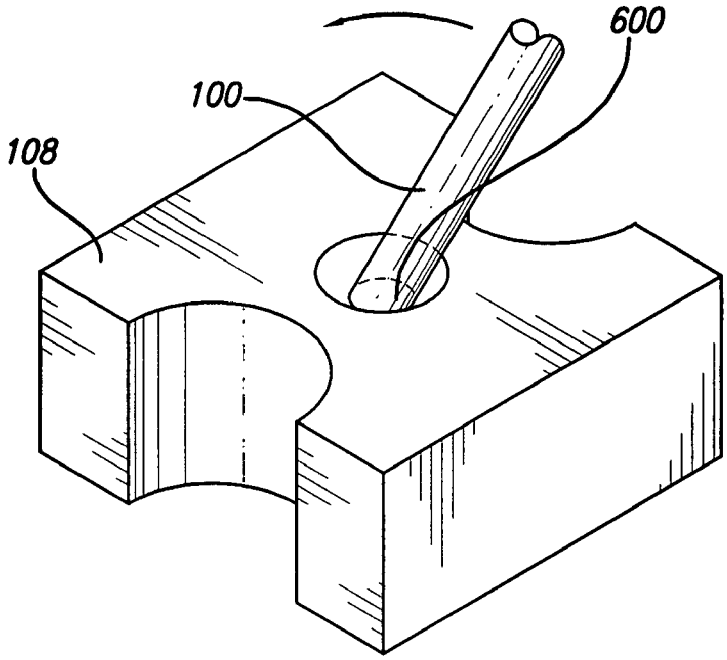
FIG. 7A is a perspective view of another embodiment of this invention.

In another embodiment, the shaft 100 is rotatably coupled to the top surface so that a golfer can rotate the shaft 100 to select a desired contact surface 104, 208 for use. For example, the shaft 100 can rotate or swivel about an axis perpendicular to the top surface 108 through the center of the attachment hole 600 as shown in FIG. 7A. This will allow the golfer to merely turn or rotate the shaft or the putter head to use the opposite contact surface without having to remove the shaft 100 from the putter. The shaft 100 can be secured in place either through a resistance mechanism, a locking mechanism, or any other mechanism known in the art for locking movable shafts in place.

Figure 7B:
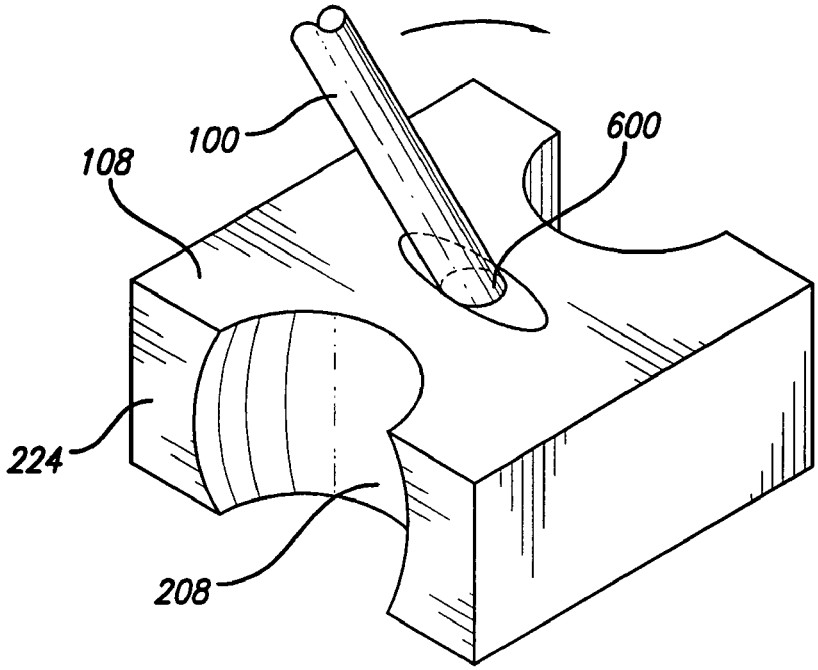
FIG. 7B is a perspective view of another embodiment of this invention.

Alternatively, the shaft 100 can be adjustably attached to the top surface 108, such that the shaft can be flipped, toggled, or shifted from a first position to a second position such that in the first position the first contact surface can be used and in the second position, the second contact surface can be used to the other side so as to use the opposite face of the putter as shown in FIG. 7B. The shaft 100 can be secured in place either through a resistance mechanism, a locking mechanism, or any other mechanism known in the art for locking movable shafts in place.

The top surface 108 can be connected to the first contact surface 104 at a top edge of the first contact surface 104. The top surface 108 can also be connected to the rear wall 106 at a top edge of the rear wall 224.

Figure 4:
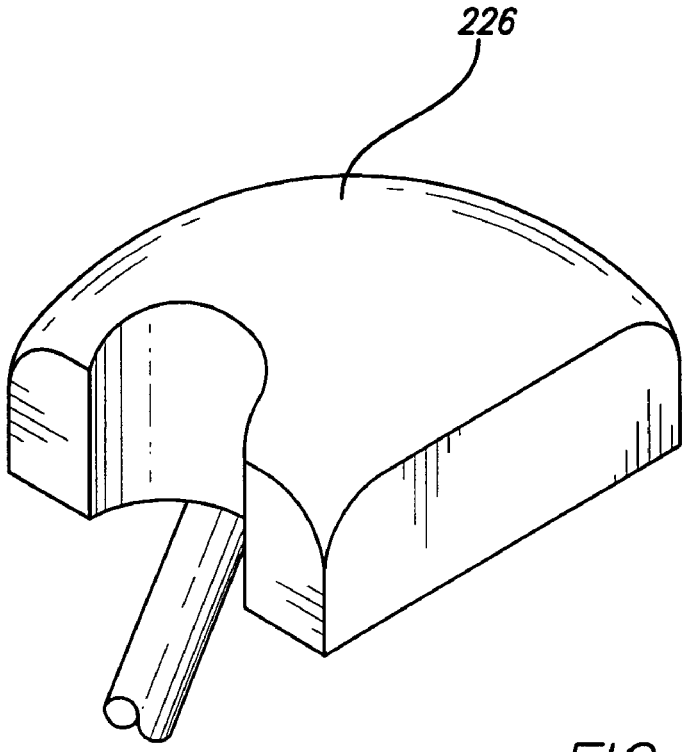
FIG. 4 is a perspective bottom view of an embodiment of the current invention.

The sole 226 can be opposite the top surface 108, connected to the first contact surface 104 at a bottom edge of the first contact surface 104, and connected to the rear wall 224 at a bottom edge of the rear wall 224. The sole 226 can be generally flat. In a preferred embodiment, the sole 226 can be generally convex. In one embodiment the rear wall 224 can be flat and the sole 226 can be flat or convex, as shown in FIG. 4. In another embodiment the rear wall 224 can be semi-circular or curved, as shown in FIGS. 3A and 3B, with a sole 226 that is be flat or convex.

The distance between the top surface 108 and the sole 226 can be at least one-half the radius of a golf ball. In one embodiment the distance between the top surface 108 and the sole 226 is about the same measurement as a golf ball radius. In another embodiment the distance between the top surface 108 and the sole 226 is about the same measurement as a golf ball diameter as shown in FIG. 5. Since the diameter of a golf ball is about 1.68 inches (47.2 mm) and the radius of a golf ball is about 0.84 inches (23.6 mm), the distance between the top surface 108 and the sole 226 can range from about 0.42 inches to about 1.68 inches. In embodiments where the sole 226 is convex, it is the distance between the top surface 108 and a bottom edge of a contact surface 104, 208 that is at least on-half the radius of a golf ball R" as shown in FIGS. 8A and B. Preferably, it is the height H, H' of the contact surface, either the first contact surface 104 or the second contact surface 208 that is at least one-half the radius of a golf ball R".

The scope of this invention includes but is not limited to a golf putter with a first contact surface 104, which can be partially-spherical or partially cylindrical, a rear wall 106 that can be flat, semi-circular or concave, a top surface 108 attached to a shaft 100, and a sole 110 that is flat or convex. In embodiments with a concave rear wall 106, the concavity can be partially-spherical or partially cylindrical. The radius of curvature can be at least the same measurement as a golf ball radius. The distance between the top surface 108 and the sole 110 is no less than one-half the radius of a golf ball radius.

While the present invention has been described with regards to particular embodiments, it is recognized that additional variations of the present invention may be devised without departing from the inventive concept.

What is claimed is:

1. A golf putter comprising a shaft and a putting head connected to the shaft, the putting head comprising:

(a) a first contact surface, wherein the first contact surface is partially-spherical and further comprises a first radius, wherein the radius of the partially-spherical face is greater than the measurement of a golf ball radius, a first perimeter edge, a second perimeter edge, a first apex, and a first depth, wherein the first depth is defined as a distance between the first apex and a first plane defined by the first perimeter edge and the second perimeter edge, and wherein the first depth is between about 0.84 inch and about 1.68 inches;

(b) a rear wall, the rear wall being opposite the first contact surface;

(c) a top surface, the shaft being connected to the putting head at the top surface, the top surface being connected to the first contact surface and to the rear wall; and (d) a sole, wherein the sole is opposite the top surface and connected to the first contact surface and the rear wall;

(e) wherein the distance between the top surface and the sole is at least one-half the radius of a golf ball.

2. The golf putter of claim 1, wherein the rear wall is flat and the sole is convex.

3. The golf putter of claim 1, wherein the rear wall is semi-circular and the sole is convex.

4. The golf putter of claim 1, wherein the shaft is connected orthoganol to the top surface.

5. The golf putter of claim 1, wherein the shaft is detachably coupled to the top surface and wherein the top surface further comprises a first attachment hole and a second attachment hole.

6. The golf putter of claim 1, wherein the shaft is rotatably coupled to the top surface so that a golfer can rotate the shaft about an axis perpendicular to the top surface.

7. The golf putter of claim 1, wherein the shaft is adjustably coupled to the top surface so that a golfer can toggle the shaft from a first position to a second position.

8. A golf putter comprising a shaft and a putting head connected to the shaft, the putting head comprising:

(a) a first contact surface, wherein the first contact surface is partially-cylindrical and further comprises a first radius, wherein the first radius is greater than the measurement of a golf ball radius, a first perimeter edge, a second perimeter edge, a first apex, and a first depth, wherein the first depth is defined as a distance between the first apex and a first plane defined by the first perimeter edge and the second perimeter edge, and wherein the first depth is between about 0.84 inch and about 1.68 inches;

(b) a rear wall, the rear wall being opposite the first contact surface;

(c) a top surface, the shaft being connected to the putting head at the top surface, the top surface being connected to the first contact surface and to the rear wall; and (d) a sole, the sole being opposite the top surface, the sole being connected to the first contact surface and to the rear wall;

(e) wherein the distance between the top surface and the sole is at least one-half the radius of a golf ball.

9. The golf putter of claim 8, wherein the rear wall is flat and the sole is convex.

10. The golf putter of claim 8, wherein the rear wall is flat and the sole is flat.

11. The golf putter of claim 8, wherein the rear wall is semi-circular and the sole is convex.

12. The golf putter of claim 8, wherein the rear wall is semi-circular and the sole is flat.

13. The golf putter of claim 8, wherein the shaft is connected orthoganol to the top surface.

14. The golf putter of claim 8, wherein the shaft is detachably coupled to the top surface and wherein the top surface further comprises a first attachment hole and a second attachment hole.

15. The golf putter of claim 8, wherein the shaft is rotatably coupled to the top surface so that a golfer can rotate the shaft about an axis perpendicular to the top surface.

16. The golf putter of claim 8, wherein the shaft is adjustably coupled to the top surface so that a golfer can toggle the shaft from a first position to a second position.

* * * * *